US009666363B2

(12) United States Patent
Kitamura

(10) Patent No.: US 9,666,363 B2
(45) Date of Patent: May 30, 2017

(54) SURFACE-MOUNT INDUCTOR AND METHOD FOR MANUFACTURING THE SAME

(71) Applicant: TOKO, INC., Tsurugashima-shi, Saitama-ken (JP)

(72) Inventor: Kazuhisa Kitamura, Tsurugashima (JP)

(73) Assignee: Murata Manufacturing Co., Ltd., Nagaokakyo-shi, Kyoto (JP)

( * ) Notice: Subject to any disclaimer, the term of this patent is extended or adjusted under 35 U.S.C. 154(b) by 0 days.

(21) Appl. No.: 14/979,656

(22) Filed: Dec. 28, 2015

(65) Prior Publication Data

US 2016/0189853 A1 Jun. 30, 2016

(30) Foreign Application Priority Data

Dec. 26, 2014 (JP) ..... 2014-264167

(51) Int. Cl.

| | |
|---|---|
| ***H01F 27/29*** | (2006.01) |
| ***H01F 27/02*** | (2006.01) |
| ***H01F 27/30*** | (2006.01) |
| ***H01F 27/28*** | (2006.01) |
| ***H01F 17/04*** | (2006.01) |
| ***H01F 41/063*** | (2016.01) |
| ***H01F 41/098*** | (2016.01) |

(52) U.S. Cl.

CPC ..... *H01F 41/063* (2016.01); *H01F 27/2852* (2013.01); *H01F 27/292* (2013.01); *H01F 27/306* (2013.01); *H01F 41/098* (2016.01); *H01F 17/043* (2013.01)

(58) Field of Classification Search

CPC . H01F 27/2828; H01F 41/063; H01F 27/2852

USPC ..... 336/192, 83, 198, 220, 221

See application file for complete search history.

(56) References Cited

U.S. PATENT DOCUMENTS 5,175,525 A * 12/1992 Smith ..... H01F 27/2866 336/183
5,331,536 A * 7/1994 Lane ..... H01F 27/2847 336/178
6,734,775 B2 * 5/2004 Chung ..... H01F 27/324 336/192
7,978,039 B2 * 7/2011 Solar ..... H01F 27/10 219/116

(Continued)

FOREIGN PATENT DOCUMENTS

JP 2003-290992 A 10/2003
JP 2004-193215 A 7/2004

*Primary Examiner* — Elvin G Enad
*Assistant Examiner* — Kazi Hossain
(74) *Attorney, Agent, or Firm* — Renner, Kenner, Greive, Bobak, Taylor & Weber

(57) ABSTRACT

A surface-mount inductor having a coil formed by winding a wire and a molded body for accommodating the coil, wherein the coil includes: a pair of first rolls of wire of a rectangular section which are wound in a two-roll arrangement, both ends of the wire being positioned at their outermost turns; and a pair of second rolls wound in positions adjacent to and each on opposite sides of the first rolls to partially overlap the first rolls, whereby the ends of the wire are brought out from the outermost turns of the second rolls as lead ends, with winding axis of the coil being parallel with the molded body and the lead ends extending over the surface of the mounting face.

1 Claim, 8 Drawing Sheets

(56) References Cited

U.S. PATENT DOCUMENTS

| | | | | |
|---|---|---|---|---|
| 2006/0145804 | A1* | 7/2006 | Matsutani | H01F 27/027 336/200 |
| 2008/0088401 | A1* | 4/2008 | Wei | H01F 27/2804 336/182 |
| 2008/0180205 | A1* | 7/2008 | Tsai | H01F 27/2866 336/192 |
| 2010/0026441 | A1* | 2/2010 | Wedley | H01F 3/12 336/221 |
| 2010/0265020 | A1* | 10/2010 | Chan | G01R 33/34069 336/170 |
| 2014/0313003 | A1* | 10/2014 | Liu | H01F 27/303 336/178 |

* cited by examiner

SURFACE-MOUNT INDUCTOR AND METHOD FOR MANUFACTURING THE SAME

CROSS REFERENCE TO RELATED APPLICATIONS

This application is based upon and claims the benefit of priority from the prior Japanese Patent Application No. 2014-264167, filed on Dec. 26, 2014, the entire contents of which are incorporated herein by reference.

BACKGROUND OF THE INVENTION

1. Field of the Invention

The present invention relates to a surface-mount inductor and a method for manufacturing the same.

2. Description of the Related Art

Conventionally, surface-mount inductors whose coils have been coated with thermoplastic sealant (molding material) containing magnetic powder and resin are widely used. For example, JP2003-290992 discloses a method for manufacturing surface-mount inductors using metal pieces as external terminals. The surface-mount inductors have external terminals which are metal pieces welded to lead ends being processed to serve as external terminals.

JP2004-193215 discloses a method for manufacturing surface-mount inductors by coating coils, which is configured by winding a wire having a rectangular section (hereinafter "rectangular wire"), with sealing material. The surface-mount inductor has external terminals which are formed by deforming lead wires of a coil.

SUMMARY OF THE INVENTION

In a surface-mount inductor disclosed in JP2003-290992, since its coil ends are welded to metal pieces, the contact portions of the coil ends and of the metal pieces are exposed to thermal and mechanical stresses. In addition, contact resistance occurs at the contact portions of the coil ends and metal pieces.

In the surface-mount inductor of JP2004-193215, since the direction of the winding axis of the coil is orthogonal to the wide surface of the rectangular wire, the inner and outer diameters are exposed to mechanical stress during winding.

Further, the surface-mount inductor in JP 2004-193215 is so configured that one lead end goes from its bottom side to the bottom and the other lead end goes from upper side to the bottom.

In this case, because of the difference in the length of the lead wires, the shape of the coil is asymmetrical. The surface-mount inductor incorporating an asymmetrical coil requires a step of marking the polarity of the terminals, since the electric characteristics when inputting in one terminal are different from those when inputting in the other terminal.

Consequently, the present invention aims to provide a surface-mount inductor that incorporates a symmetrical coil, has less mechanical and thermal stresses, eliminates contact resistance between a coil and the external terminals, and provides a method for manufacturing the same.

Means for Solving the Problem

A surface-mount inductor having a coil formed by winding a wire and a molded body for accommodating the coil, according to the present invention is characterized in that the coil comprises:

a pair of first rolls of wire of a rectangular section which are wound in a two-roll arrangement, both ends of the wire being positioned at their outermost turns; and a pair of second rolls wound in positions adjacent to and each on opposite sides of the first rolls to partially overlap on the first rolls, whereby the ends of the wire are brought out from the outermost turn of the second rolls as lead ends, a winding axis of the coil is parallel with the molded body and the lead ends extend over the surface of the mounting face.

A method for manufacturing a surface-mount inductor, according to the present invention is characterized by comprising:

a step of making a coil by forming a pair of first rolls contacting the median portion of the wire having rectangular section to the spindle of a winding machine to wind and positioning both ends of the wire at the outermost turns, by arranging a jig at the central portion of the first rolls, by forming a pair of second rolls on the first rolls at positions each on opposite sides of the first rolls to partially overlap on the first rolls, and by forming lead ends brought out from the outermost turns of the second rolls, and a step of incorporating the coil inside the molded body, whereby the coil is incorporated in the molded body, arranging the winding axis to be parallel with the mounting face of the molded body, and the lead ends to extend over the surface of the molded body.

Effect of the Invention

According to the surface-mount inductor and the manufacturing method of the same as described in the present application, since the lead ends of coil are used as external terminals, the thermal and mechanical stresses are decreased and the contact resistance between the coil and the external terminals are eliminated. Further, since the direction of the winding axis and that of the wide surface of the coil are parallel, the mechanical stress caused at the inner and outer diameter portions may be decreased. In addition, since the coil is wound such that the direction of the mounting face of the surface-mount inductor and the direction of winding axis of the coil are parallel, the shape of the coil may be symmetrical.

Therefore, a surface-mount inductor, which serves to decrease the thermal and mechanical stresses and the contact resistance, and to solve the issue of polarities of electrical characteristics polarity, as well as a method for manufacturing the same can be provided.

DETAILED DESCRIPTION OF THE INVENTION

Embodiment 1

The first embodiment of a surface mount inductor according to the present invention will now be described with reference to FIGS. 1 through 7.

Figure 1:
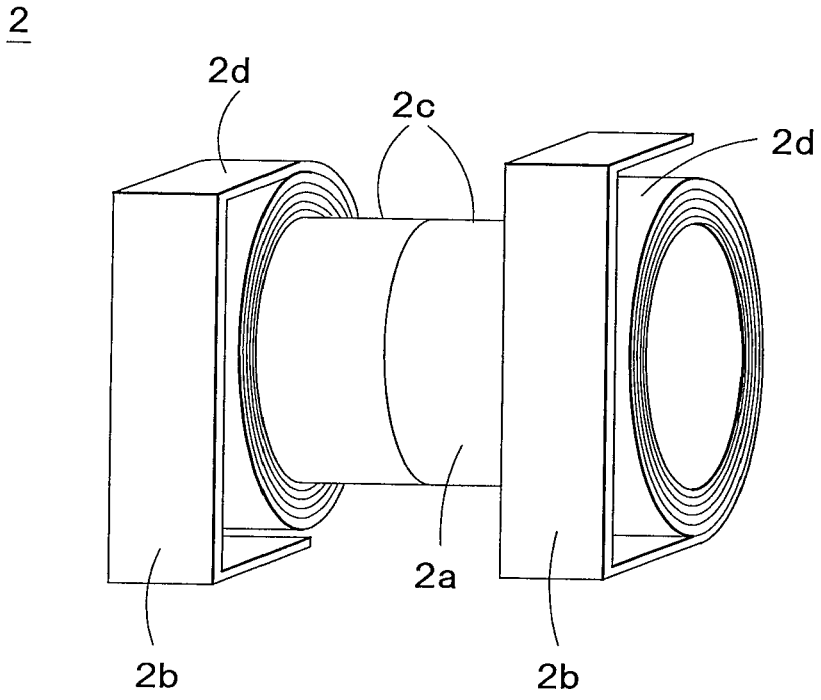
FIG. 1 is a perspective view of a surface-mount inductor of the first embodiment according to the present invention.

As shown in FIG. 1, a coil 2 is a coreless (empty core) coil having symmetrical profile when viewed from a direction orthogonal to the axial line. The coil 2 has two first rolls 2*c*, which are such configured that both ends of a rectangular wire are positioned at the outermost turn and are positioned adjacently along the winding axis, and two second rolls 2*d*, which are configured as two rolls, the inner diameters of which are equal to or larger than the outer diameters of the first rolls 2*c*, and the second rolls 2*d* are positioned adjacent to the first rolls 2*c* on opposite sides along the winding axis of the coil 2.

From the outermost turn of the second rolls 2*d*, the lead ends 2*b*, which are the ends of the rectangular wire, are brought to the extending direction of the outer peripheries. The respective lead ends 2*b* are brought toward opposite directions from the winding axis and the end portions are formed to be U-shaped to shelter the outermost turn of the coil 2.

The coil 2 thus formed does not suffer from mechanical stress around the inner and outer diameter portions when winding, because the direction of the wide surfaces 2*a* and the direction of the rectangular wire are parallel.

Figure 2A:
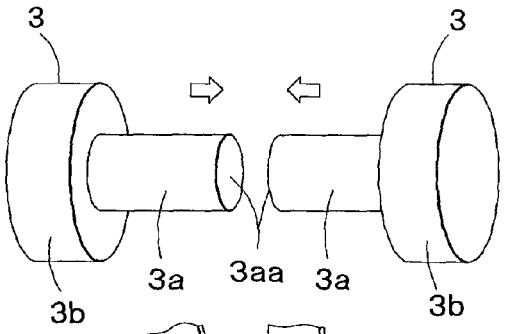
FIGS. 2A, 2B, 2C and 2D show steps in method of winding a coil which is used in the surface-mount inductor of the first embodiment according to the present invention in sequential manner.

FIGS. 2A through 2D show a method for winding the coil 2. A winding machine (not shown) is used to wind the coil 2. The winding machine provided with a pair of spindles 3 each having a winding core 3*a* and a base portion 3*b* (FIG. 2A). A rectangular wire with insulation is so arranged that the wide surface 2*a* is in contact with the winding core 3*a* (FIG. 2B), and the rectangular wire is wound on the winding core 3*a* by using a jig 3*c*, which has a C-shaped mouth at the tip, to form the coil 2.

The pair of the spindles 3 has a cylindrical winding core 3*a*, and a cylindrical base portion 3*b*, respectively. The base portions 3*b* have a larger outer diameter than the outer diameter of the winding cores 3*a*, and are arranged to be coaxial with and adjacent to the winding cores 3*a*. The jig 3*c* has the C-shaped mouth at its tip, and the thickness of the jig 3*c* is the same as the width of the wide surface 2*a* of the rectangular wire used in the coil 2.

The length of the winding core 3*a* in the direction of the winding axis is longer than the width of the rectangular wire used in the coil 2. A tip 3*aa* of the spindle 3 is the end surface of the winding core 3*a* opposite to the base portion 3*b*.

Firstly, the two spindles 3 are positioned in a manner that the spindle tips 3*aa* face each other, as shown in FIG. 2A.

Figure 2B:
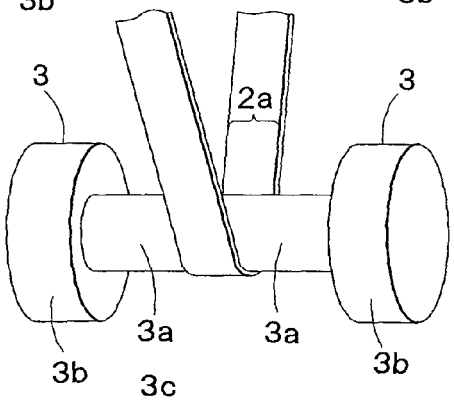

Then, as shown in FIG. 2B, the wide surface 2*a* of the median portion of the rectangular wire is put in contact with the winding cores 3*a*. The ends of the rectangular wire are repetitively wound in opposite directions around the winding cores 3*a*. Thus, two first rolls 2*c* are formed in two-roll arrangement in the direction of the winding axis, rolls being positioned adjacent to each other.

Figure 2C:
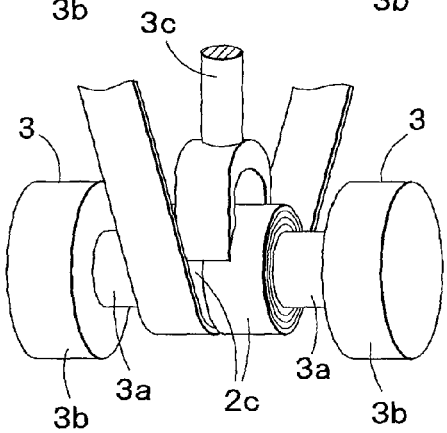

And, as shown in FIG. 2C, the jig 3*c* is so positioned that the tip 3*aa* is at the center of the first rolls 2*c* of two-roll arrangement so as to prevent to wind the rectangular wire on the portion where the jig 3*c* contacts the first rolls 2*c*.

And then, the rectangular wire is wound on the first rolls 2*c* to be shifted to each other in opposite directions in partially overlapping manner to form a second rolls 2*d* at both sides of the jig 3*c*. After that, the rectangular wire is pulled from the outermost turn of the second rolls 2*d* to form the lead ends 2*b* (see FIG. 2D).

Figure 2D:
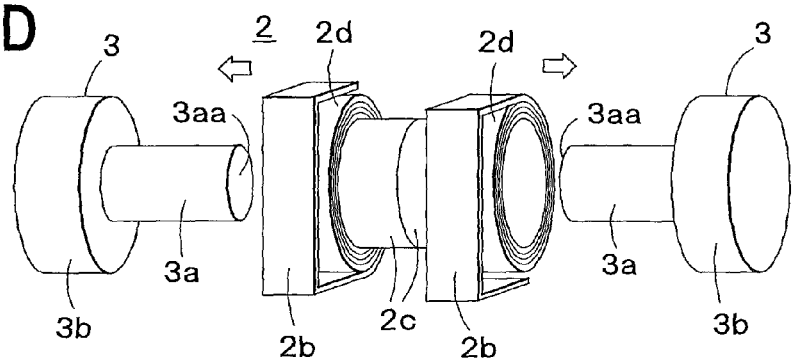

The lead ends 2*b* are pulled from the outermost turn of the coil 2 in its extended directions oppositely each other and the ends thereof are bent to form U-shaped portions. The coil 2 is heated and solidified, and then is removed thereafter from the spindles 3, as shown in FIG. 2D, to manufacture the coil 2 which is symmetrical relative to a direction orthogonal to the winding axis.

A molded body 4 which includes the coil 2 will be described in reference to FIG. 3. The molded body 4 is formed by fitting two blocks 4*a*. The block 4*a* is formed by applying pressure to sealant which contains filler with metallic magnetic powder and epoxy resin.

Figure 3:
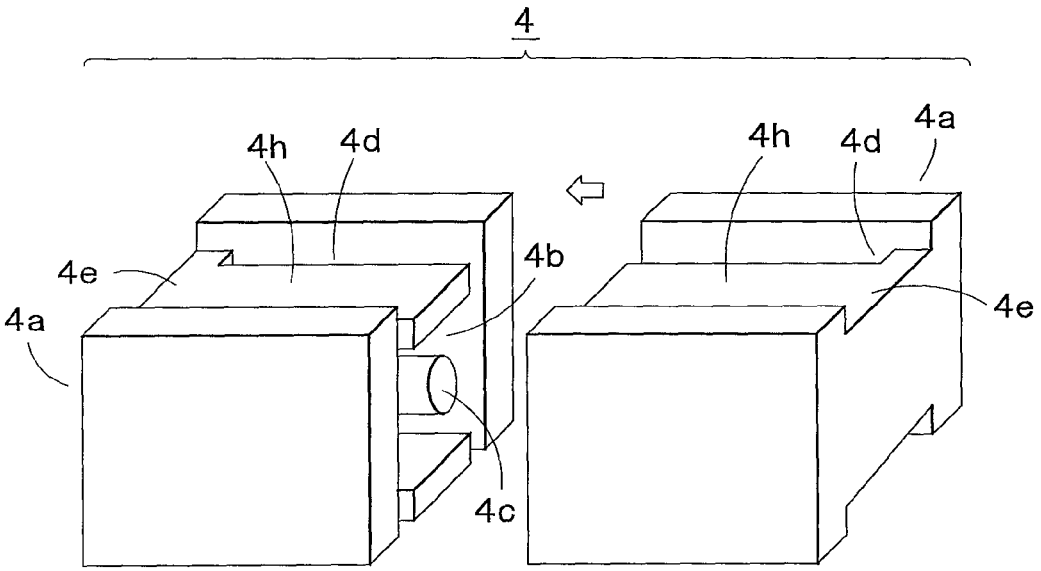
FIG. 3 is a perspective view of the block which is used in the first embodiment according to the present invention.

As shown in FIG. 3, the blocks 4*a* are rectangular parallelepipeds having open end surface and a space 4*b* to accommodate the coil 2 inside. The cylindrical protrusion 4*c* to pass through the central hole of the coil 2 extends from the central portion of inner wall of the opposite end surface toward the open end surface. The upper and bottom surfaces of the block 4*a* have the same shape, with one of them serving as the mounting face 4*e* (the upper surface in FIG. 3).

Figure 4:
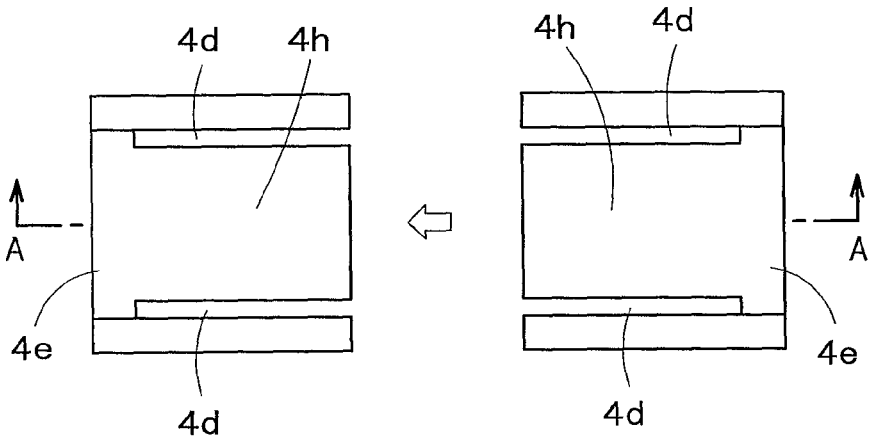
FIG. 4 is a plan view of the mounting face of the block which is used in the surface-mount inductor of the first embodiment according to the present invention.

As shown in FIG. 4, the mounting faces 4*e* are rectangular, with the open surface forming the short side and the other surface forming the long side. At both short sides of the mounting face 4*e*, the elongated slits 4*d* for bringing out the lead ends 2*b* therethrough are provided.

The portion of the mounting face 4*e* bordered by the slits 4*d* forms the supporting portion 4*h* which serves to support the lead ends 2*b* of the coil 2. Namely, the two slits 4*d* and the supporting portion 4*h* constitutes the U-shaped supporting structure to fit to the sectional shape of the lead ends 2*b* (FIGS. 2A-2D).

Figure 5A:
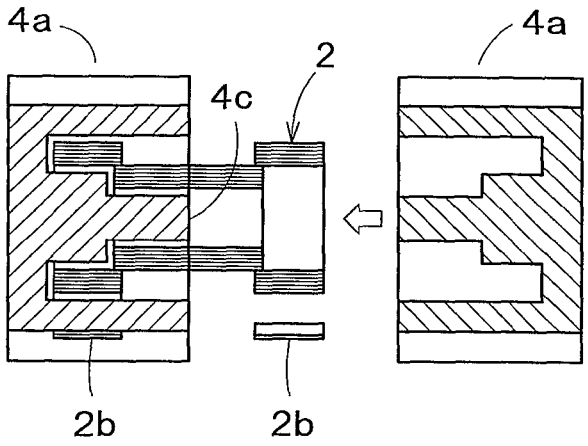
FIGS. 5A, 5B and 5C show steps for manufacturing the surface-mount inductor of the first embodiment according to the present invention, FIG. 5A showing the state before blocks being fitted, FIG. 5B showing the attached blocks, and FIG. 5C showing the state of the mounting face after fitting.
Figure 5B:
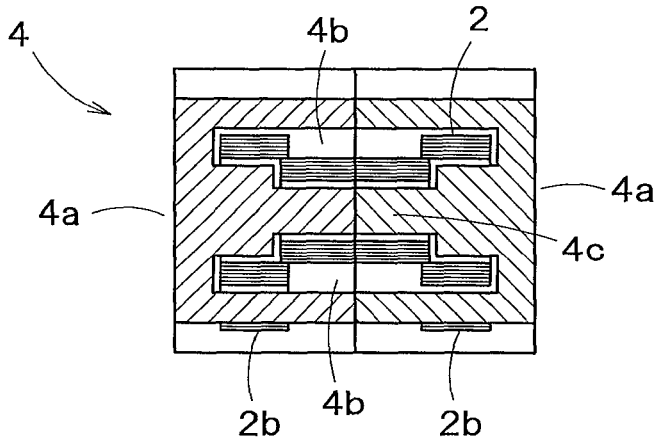
Figure 5C:
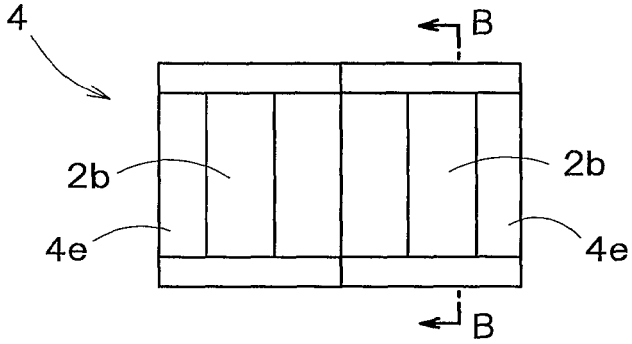

Next, the method for sealing the coil are described, referring to FIGS. 5A-5C,.

FIGS. 5A and 5B are sectional views along the line A-A in FIG. 4, namely a sectional view parallel with the mounting face 4*e*, while FIG. 5C is a plan view of the mounting face 4*e*.

As shown in FIG. 5A, the blocks 4*a* are arranged on both sides of the direction of the axis of the coil 2 in a manner that the open sides face each other. In one of the blocks 4*a*, the protrusion 4*c* of the block is inserted into the central hole of the coil 2 and the lead end 2*b* is pulled out through the slit 4*d* of the mounting face 4*e*.

FIG. 5B shows a state that where other block 4*a* is fitted from the direction of the winding axis of the coil 2. The space 4*b* for accommodating the coil 2 is provided in the inside the block 4*a*. The coil 2 is accommodated inside the two blocks 4*a* with the protrusions 4*c* being inserted into the central portion of the coil 2. The lead end 2*b* is brought out through one of the two slits 4*d* so as to be parallel with the short side of the mounting face 4*e* and inserted into the other slit 4*d* to be U-shaped in section.

In this state, the two blocks 4*a* which incorporate the coil 2 are pressed in a mold and then heated (thermocompressed). Thus, as shown in FIG. 5C, the lead ends 2*b* of the coil 2 are fixed to the mounting face 4*e* so as to be visible, and the two blocks 4*a* are solidified to form a molded body 4 sealing the coil 2 inside.

Figure 6:
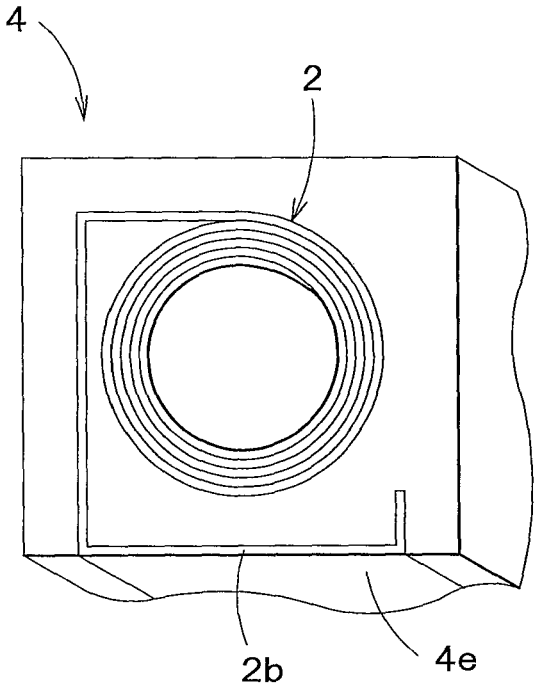
FIG. 6 is a partial sectional view showing the method of manufacturing of the surface-mount inductor of the first embodiment according to the present invention.

FIG. 6 shows the step for forming the external terminals by processing the lead ends 2*b*. FIG. 6 is the sectional view along the line B-B in FIG. 5C.

The lead ends 2*b*, which are embedded in the mounting face 4*e*, and the portion of the lead ends exposed are machined by laser beam to remove the insulation cover therefrom. Because of the flatness of the rectangular wire, the settings for laser processing are uncomplicated. As the laser processing is used to remove the insulation of one face, the process does not require to be repeated.

The lead ends 2*b* are simultaneously sputtered with predetermined ratio of Ni and Cu to form a Ni—Cu layer, subsequently sputtering with Sn to form a Sn layer so as to process the lead ends 2*b* into the external terminals. Because of using the rectangular wire, the adhesiveness to other components may be improved, compared to the case of using a round wire. In addition, the evenness of the mounting face 4*e* can be raised.

Figure 7:
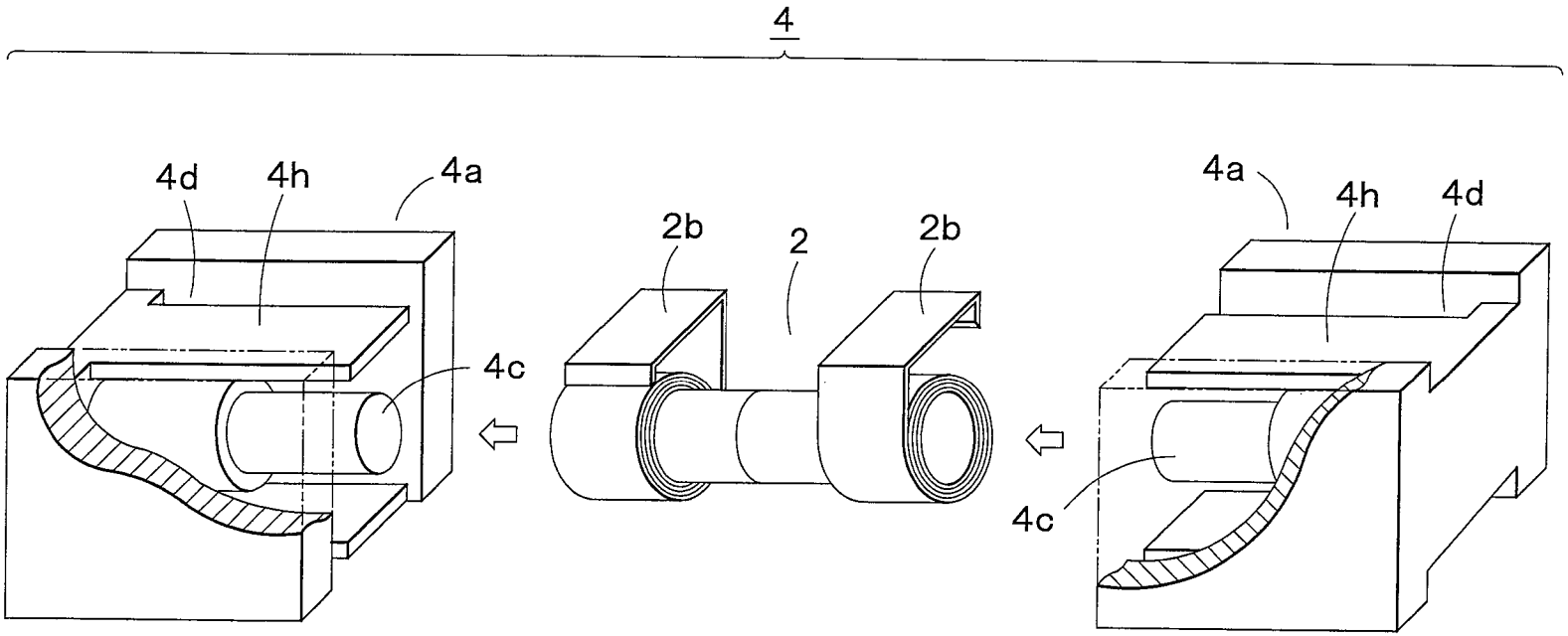
FIG. 7 shows the step for fitting the two blocks and the coil of the first embodiment according to the present invention.

FIG. 7 shows the steps for fitting the two blocks 4*a* and the coil 2 according to the first embodiment of the present invention. The left end of the coil 2 is inserted into the block 4*a* (left side in FIG. 7). For this process, the center of the coil 2 is positioned on the protrusion 4*c* of the block 4*a*, and the lead end 2*b* (left side in FIG. 7) of the coil 2 is positioned to be mounted on the supporting portion 4*h* of the block 4*a*. Thus, the coil 2 is pressed toward the left as indicated by the arrow in FIG. 7 so that the coil 2 is fitted with the block 4*a* on the left in FIG. 7.

Then, the block 4*a* on the right side in FIG. 7 is fitted with the left side block 4*a* which is already fitted with the coil 2. For such a process, the central hole of the coil 2 is positioned on the protrusion 4*c* of the block 4*a* at the right side in FIG. 7, and the right-side supporting portion 4*h* is aligned with the right-side lead end 2*b*, and then the block 4*a* on the right side in FIG. 7 is pressed toward the left side as shown by the arrow. As a result, the U-shaped portion of the lead ends 2*b* holds the supporting portion 4*h* and is in turn supported by the supporting portions 4*h*.

Accordingly, the two blocks 4*a* are joined via the coil 2 so the three of them are integrated together. As described before referring to FIG. 5, the molded body 4 is formed by thermocompressing.

Since the surface-mount inductor produced as described above has an entirely symmetrical shape, the electric characteristics are the same regardless which of the input terminals receives an input. Therefore, there is no need for marking so as to discriminate terminals thus manufacturing cost can be reduced.

Embodiment 2

Figure 8:
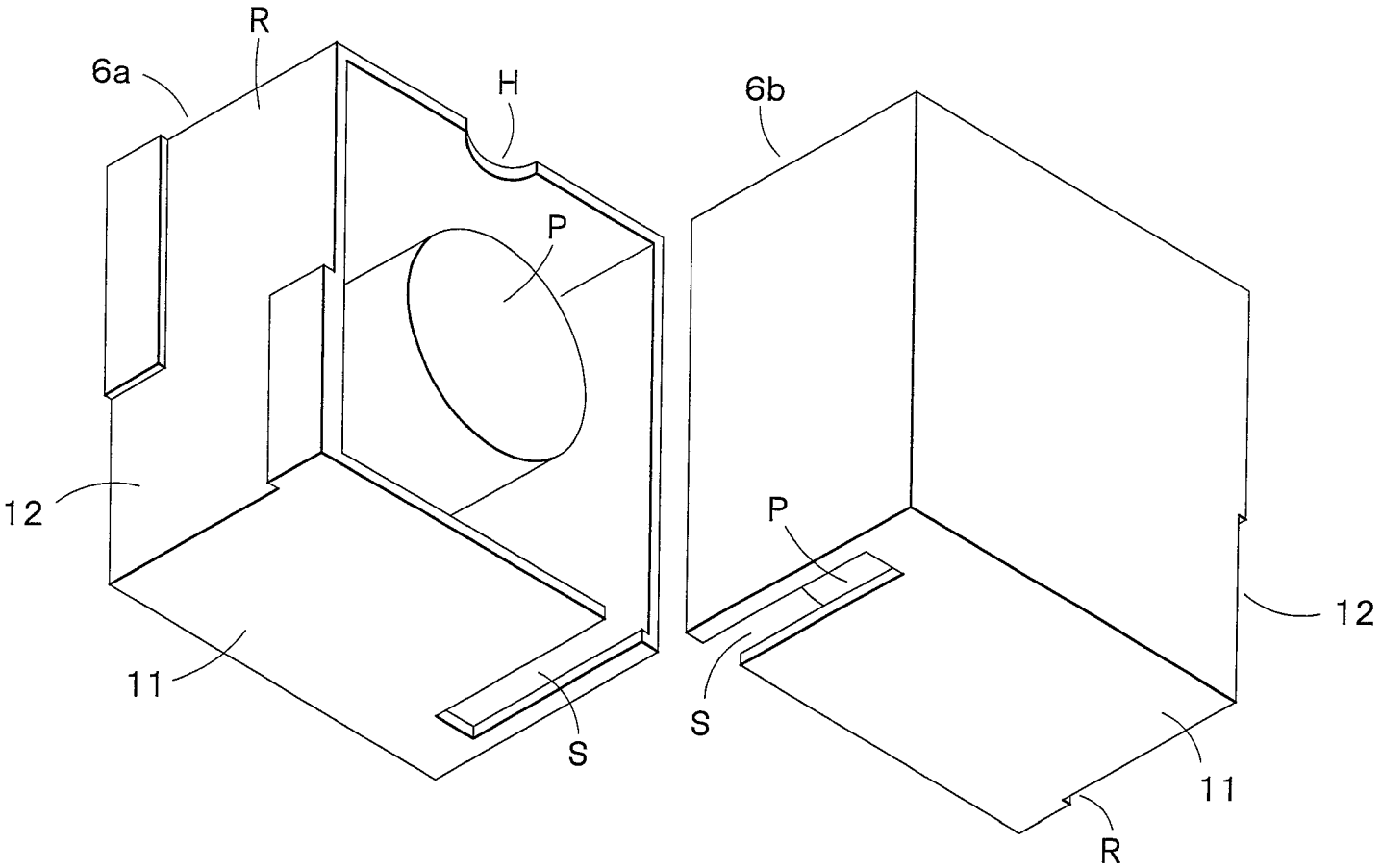
FIG. 8 is a perspective view showing the magnetic core of the second embodiment according to the present invention.
Figure 9:
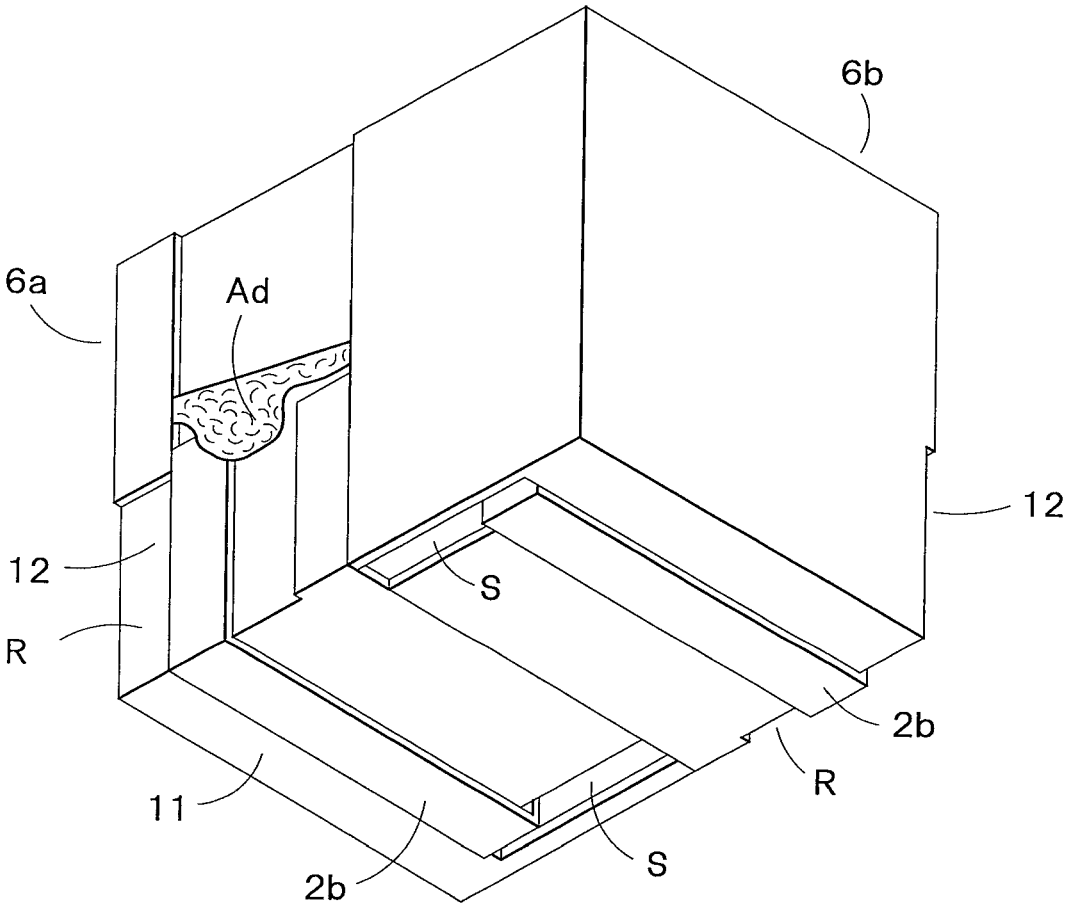
FIG. 9 is a perspective view showing the surface-mount inductor according to the present invention.

The surface-mount inductor and the method for manufacturing the same according to the second embodiment of the present invention are described in reference to FIGS. 8 and 9. The second embodiment is a surface-mount inductor incorporating the coil 2 in a molded body consisting of a magnetic core and sealant.

Firstly, the coil 2 is formed according to the same method as the one used for the first embodiment. Then, as shown in FIG. 8, a pair of bottomed magnetic cores 6*a*, 6*b* which includes a protrusion P to be inserted into the central hole of the coil 2, a slit S for bringing out the lead ends 2*b* to the mounting face 11, a hole H provided at the aperture side of a surface opposing the mounting face 11 and a recess R formed on the auxiliary surface is installed on the coil 2. The pair of bottomed magnetic cores 6*a*, 6*b* is installed on the coil 2 in a manner that the protrusion P is inserted into the central hole of the coil 2 from both sides and that the lead ends 2*b* are inserted into the slit S.

Further, the lead ends 2*b* of the coil 2 which is accommodated in the pair of bottomed cores 6*a*, 6*b*, are bent along the magnetic cores 6*a*, 6*b* to extend over the mounting face 11 and the surface 12 ("auxiliary surface 12" hereinafter) adjacent to the mounting face 11. The portions of the lead ends 2*b* extending over the auxiliary surface 12 of the magnetic cores 6*a*, 6*b* are bent upward from the mounting face of the magnetic cores 6*a*, 6*b* and are arranged in the recess R formed on the auxiliary surface 12.

And then, as shown in FIG. 9, the ends of the lead ends of the coil 2 arranged in the recess R are secured thereto by means of an adhesive Ad.

Furthermore, the magnetic cores 6*a*, 6*b* housing the coil 2 are arranged in a mold, directing the mounting face 11 of the magnetic cores 6*a*, 6*b* upward, and sealant is poured into the mold. The molding resin is poured to expose the mounting face 11 of the magnetic cores 6*a*, 6*b*. Thanks to the provision of the slit S and of the hole H, the magnetic cores 6*a*, 6*b* may be completely filled with the sealant so that the sealant is filled up to the same level as the mounting face 11 in the slit S of the magnetic cores 6*a*, 6*b*.

Subsequently, hardening the sealant and taking out from the mold, a molded body 4 is formed. In the molded body 4, the coil 2 is incorporated in a manner that the winding axis is parallel with the mounting face 11, and the lead ends of the coil 2 extend over the mounting face and the auxiliary surface, and the magnetic cores 6*a*, 6*b* are entirely sealed by the sealant exposing the mounting face 11 of the magnetic cores 6*a*, 6*b*, and the lead ends 2*b* are sealed by the sealant.

The lead ends 2*b* of the coil 2 extending over the mounting face 4*e* of the molded body 4, which consists of the mounting faces of the magnetic cores 6*a*, 6*b*, are used as external terminals, the insulation coating being removed. Electrodes covering the portions of lead ends 2*b*, which are extending over the mounting face 4*e* of the molded body 4, are provided in order to form the external terminals.

Although the surface-mount inductor and the method for manufacturing the same has been described in relation to the embodiments, the present invention should not be limited thereto. A part of blocks may be substituted by a magnetic core, and a part of magnetic cores may be substituted by a block. The mounting face of the magnetic core may be covered with the sealant to expose the surface of the lead ends. Further, the sealant may include ferrite powder.

Furthermore, the molded body may have a pair of metal bodies. The pair of metal bodies is so formed that which covers the upper, end surfaces and the side surfaces adjacent to the upper and end surfaces, and that the lower ends thereof reach the same level as the surface of the external terminals provided at the mounting face of the molded body. The pair of metal bodies is attached at the both ends of the molded body to make a gap between the metal body and the external terminals. In this case, the metal bodies are attached not to contact mutually.

When mounting and soldering the surface-mount inductor described above on a wiring board, the gaps between the metal bodies and the external terminals may be filled with solder fillet so as to firmly secure the surface-mount inductor to the board. In addition, external noise can be prevented.

Further, in the second embodiment, the mounting face of the magnetic core may be covered with the sealant to expose the surface of the lead ends.

EXPLANATION OF CODES

1 surface-mount inductor
2 coil
2*a* wide surface
2*b* lead end
2*c* first roll
2*d* second roll
3 spindle
3*a* winding core
3*aa* tip
3*b* base portion
3*c* jig
4 molded body
4*a* block
4*b* space
4*c* protrusion
4*d* slit
4*e* mounting face
5 external terminal
6*a*, 6*b* magnetic core
11 mounting face
12 auxiliary surface
P protrusion
S slit
H hole
R recess
Ad adhesive

What is claimed is:

1. A surface-mount inductor having a coil formed by winding a wire and a molded body for accommodating the coil inside, the molded body being provided with a mounting face outside wherein the coil comprises:

a pair of first rolls of wire of a rectangular section which are wound in a two-roll arrangement, both ends of the wire being positioned at their outermost turns; and a pair of second rolls wound in positions adjacent to and each on opposite sides of the first rolls to partially overlap the first rolls, the inner diameter of the second rolls being larger than the outer diameter of the first rolls;

whereby the ends of the wire are brought out from the outermost turn of the second rolls as lead ends, a winding axis of the coil is parallel with the molded body and the lead ends extend over the surface of the mounting face.

* * * * *